US008312580B2

(12) United States Patent
Lee

(10) Patent No.: US 8,312,580 B2
(45) Date of Patent: Nov. 20, 2012

(54) FOLDING KNIFE

(75) Inventor: Victor Lee, New York, NY (US)

(73) Assignee: Master Cutlery Inc., Secaucus, NJ (US)

( * ) Notice: Subject to any disclaimer, the term of this patent is extended or adjusted under 35 U.S.C. 154(b) by 276 days.

(21) Appl. No.: 12/868,493

(22) Filed: Aug. 25, 2010

(65) Prior Publication Data

US 2012/0047660 A1 Mar. 1, 2012

(51) Int. Cl.
*B26B 11/00* (2006.01)

(52) U.S. Cl. ..... 7/118

(58) Field of Classification Search ..... 7/100, 118, 7/158, 170, 125, 127, 128, 168, 119; 30/152, 30/162, 154, 155, 123, 151, 298.4, 342, 146, 30/143; 362/109, 119, 120, 253; 81/427.5, 81/300, 177.2, 177.6, 423; 294/26
See application file for complete search history.

(56) References Cited

U.S. PATENT DOCUMENTS

| | | | | |
|---|---|---|---|---|
| 5,542,139 | A * | 8/1996 | Boivin | 7/118 |
| 5,657,543 | A * | 8/1997 | Collins | 30/367 |
| 6,453,564 | B1 * | 9/2002 | Foley | 30/359 |
| 6,592,236 | B1 * | 7/2003 | Lin | 362/119 |
| 6,725,545 | B2 * | 4/2004 | Frank | 30/155 |
| 7,028,591 | B2 * | 4/2006 | Dallas et al. | 81/300 |

* cited by examiner

*Primary Examiner* — Robert Pezzuto
(74) *Attorney, Agent, or Firm* — Walter J. Tencza, Jr.

(57) ABSTRACT

An apparatus including a housing, and a knife connected to the housing, wherein the knife at least partially folds into the housing. The apparatus also may include a first device for cracking a vehicle windshield, wherein the first device is connected to the housing. The apparatus may also include a second device for cutting a vehicle seat belt, wherein the second device is connected to the housing and at least partially folds into the housing. The knife may be connected to the housing so that the knife rotates in order to at least partially fold into the housing. The first device may include a first spring so that the first device can be compressed into the housing or expanded away from the housing. The second device may be connected to the housing so that the second device rotates in order to at least partially fold into the housing.

20 Claims, 11 Drawing Sheets

FOLDING KNIFE

FIELD OF THE INVENTION

This invention relates to improved methods and apparatus concerning folding knives.

BACKGROUND OF THE INVENTION

There are various devices known in the prior art for folding knives.

SUMMARY OF THE INVENTION

At least one or more embodiments of the present invention provide an apparatus comprising a housing, a knife connected to the housing, wherein the knife at least partially folds into the housing, and a first device for cracking a vehicle windshield, wherein the first device is connected to the housing. The apparatus may also include a second device for cutting a vehicle seat belt, wherein the second device is connected to the housing and at least partially folds into the housing. The knife may be connected to the housing so that the knife rotates in order to at least partially fold into the housing.

The first device may include a first spring so that the first device can be compressed into the housing or expanded away from the housing. The second device may be connected to the housing so that the second device rotates in order to at least partially fold into the housing. The first device may include a first member, and wherein the first device is configured with respect to the housing so that in a rest state, the first member protrudes out from the housing. The first device may be configured with respect to the housing so that a force can be applied to the first member which pushes the first member at least partially into the housing and which causes the first spring to compress. The first device may include a second member, wherein the first member is connected to the second member and the first member is configured to slide into the second member when the force is applied to the first member which pushes the first member at least partially into the housing. The first member may be substantially cylindrical and the second member may be substantially cylindrical. The second device for cutting a seat belt may include a U-shaped cutting edge located within an interior of a hook.

At least one embodiment of the present invention may also include a method comprising gripping an apparatus using a person's hand, and hitting a vehicle windshield with the apparatus while gripping the apparatus using the person's hand. The method may further include cutting a vehicle seat belt using a second device of the apparatus.

DETAILED DESCRIPTION OF THE DRAWINGS

Figure 1:
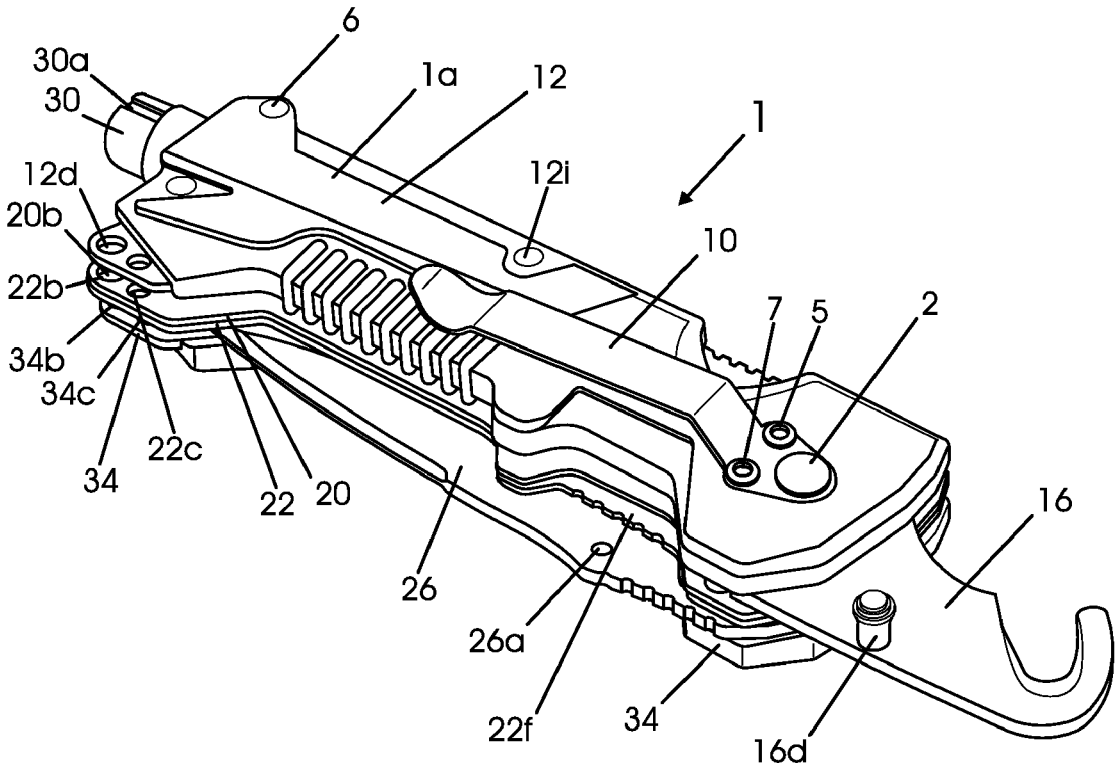
FIG. 1 shows a top, front, left side perspective view of a folding knife in accordance with an embodiment of the present invention wherein the folding knife is in a first state in which a device extends out from an overall housing while a blade is in a closed position.

FIG. 1 shows a top, front, left side perspective view of a folding knife 1 in accordance with an embodiment of the present invention wherein the folding knife 1 is in a first state in which a device 16 extends out from an overall housing 1*a* while a blade 26 is in a closed position.

Figure 2:
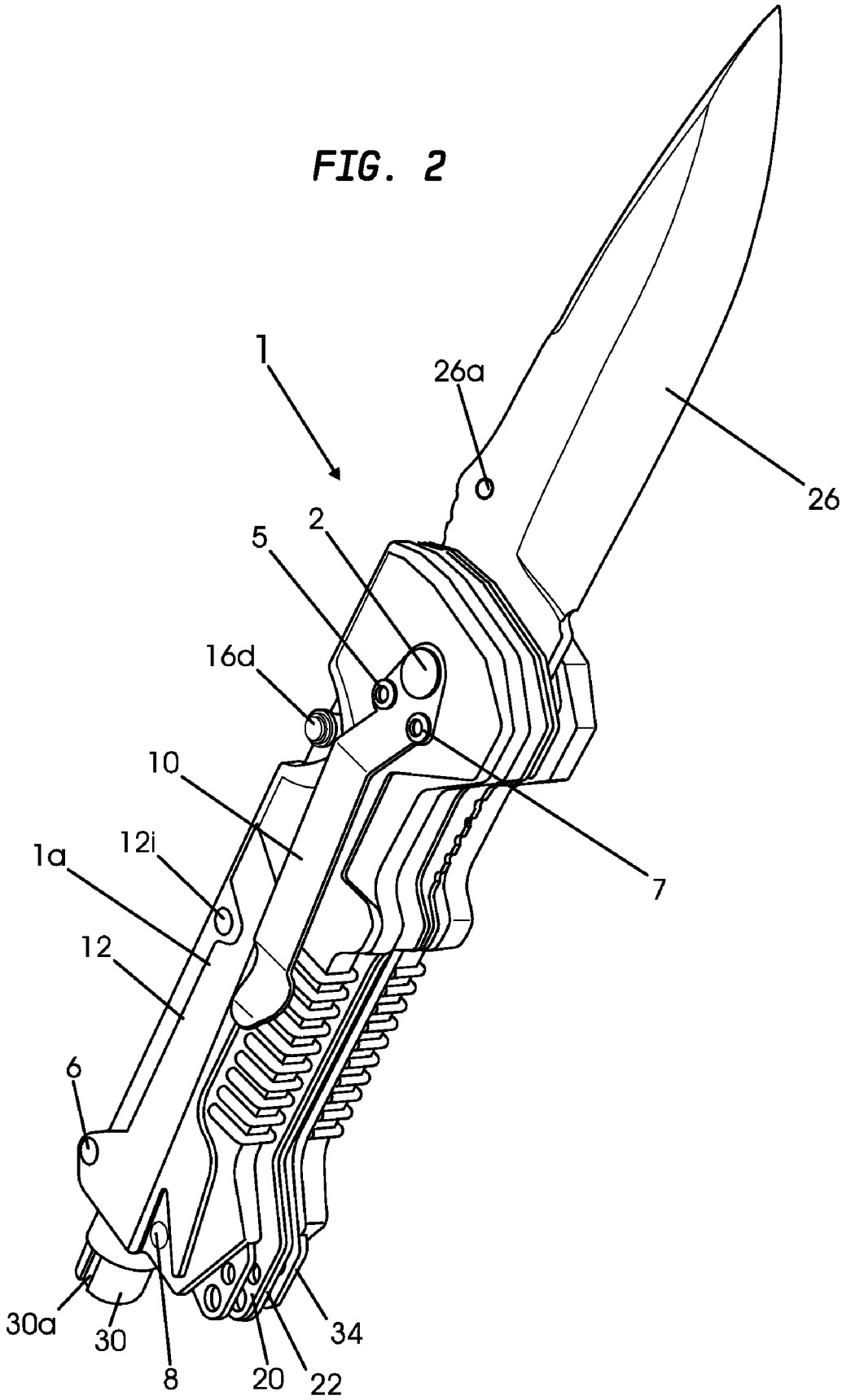
FIG. 2 shows a top, front, left side perspective view of the folding knife of FIG. 1, wherein the folding knife is in a second state, with the blade shown extending from an overall housing of the folding knife while the device is in a closed position.

FIG. 2 shows a top, front, left side perspective view of the folding knife 1 of FIG. 1, wherein the folding knife 1 is in a second state, with the blade 26 shown extending from the overall housing 1*a* of the folding knife 1 while the device 16 is in a closed position.

Figure 3:
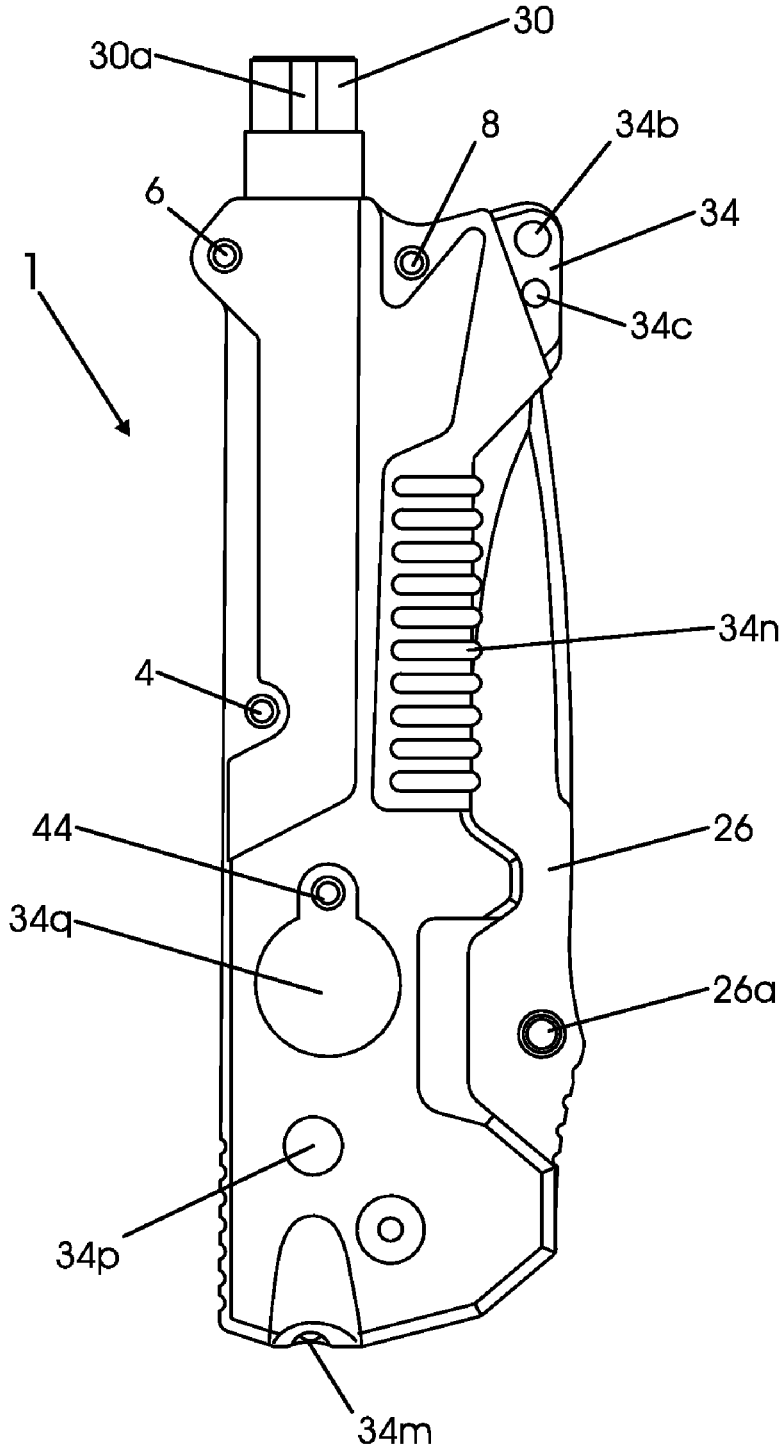
FIG. 3 shows a bottom planar orthogonal view of the folding knife of FIG. 1 with the folding knife in a third state such that the blade and the device are in a closed position.

FIG. 3 shows a bottom planar orthogonal view of the folding knife 1 of FIG. 1 with the folding knife in a third state such that the blade 26 and the device 16 are in a closed position.

Figure 4:
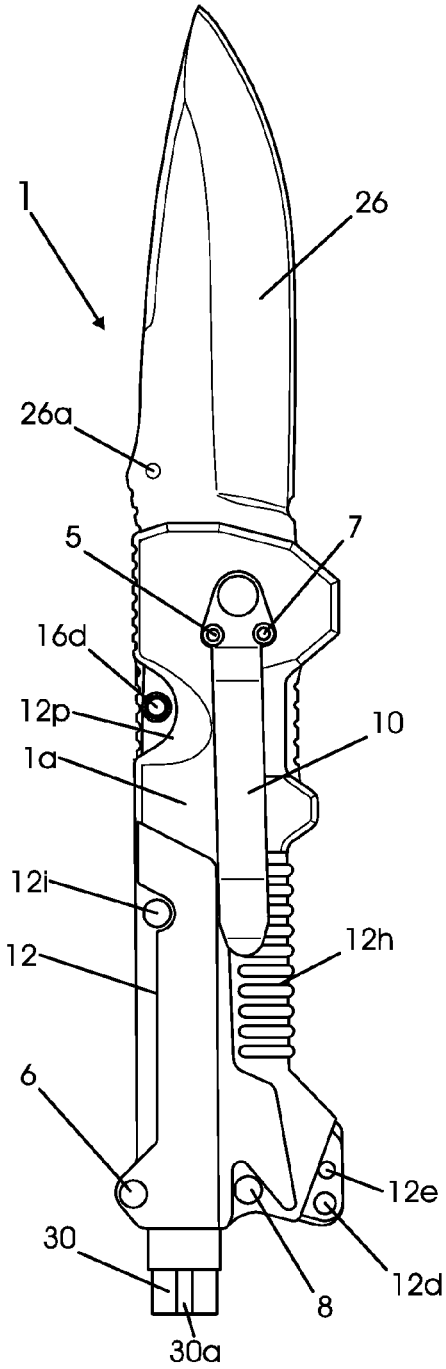
FIG. 4 shows a top planar orthogonal view of the folding knife of FIG. 1 with the folding knife in the second state of FIG. 2, with the blade extending from the overall housing of the folding knife and the device in a closed position.

FIG. 4 shows a top planar orthogonal view of the folding knife 1 of FIG. 1 with the folding knife 1 in the second state of FIG. 2, with the blade 26 extending from the overall housing 1*a* of the folding knife 1 and the device 16 in a closed position.

Figure 5:
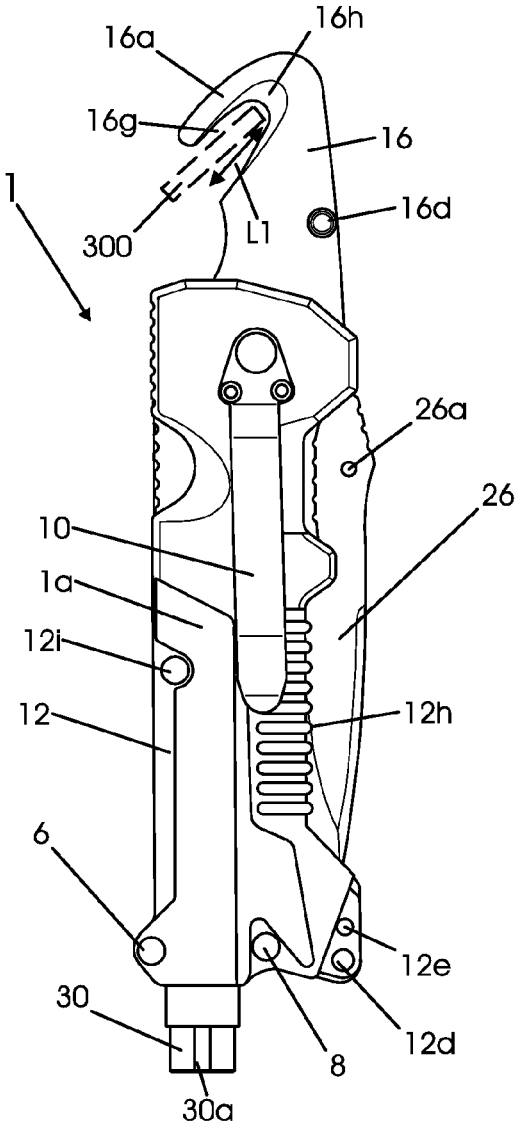
FIG. 5 shows a top planar orthogonal view of the folding knife of FIG. 1 with the folding knife in the first state of FIG. 1, with the device extending from the overall housing of the folding knife, while the blade is in a closed position.
Figure 6:
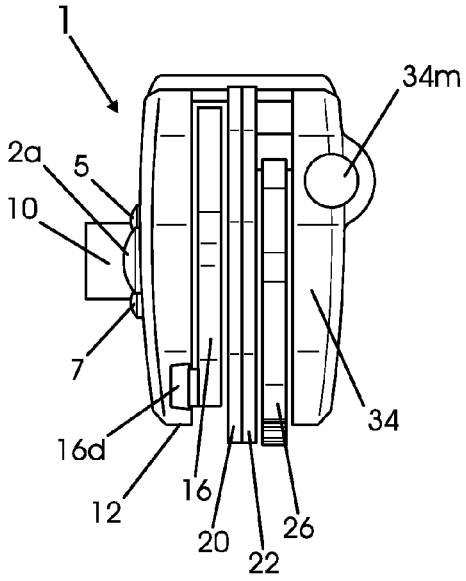
FIG. 6 shows a front planar orthogonal view of the folding knife of FIG. 1 with the folding knife in the first state of FIG. 1.
Figure 7:
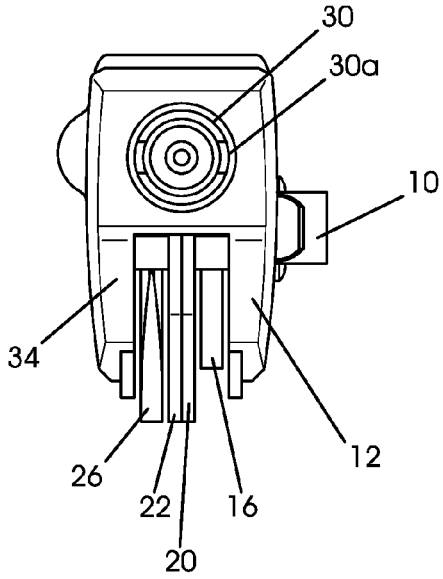
FIG. 7 shows a rear planar orthogonal view of the folding knife of FIG. 1 with the folding knife in the first state of FIG. 1.
Figure 8:
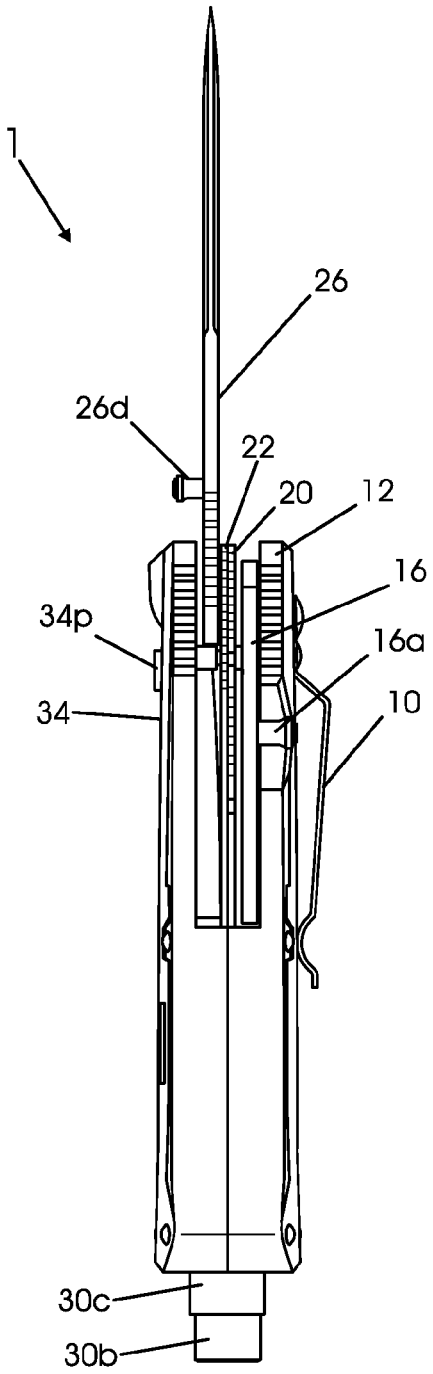
FIG. 8 shows a right side planar orthogonal view of the folding knife of FIG. 1 with the folding knife in the second state of FIG. 2.
Figure 9:
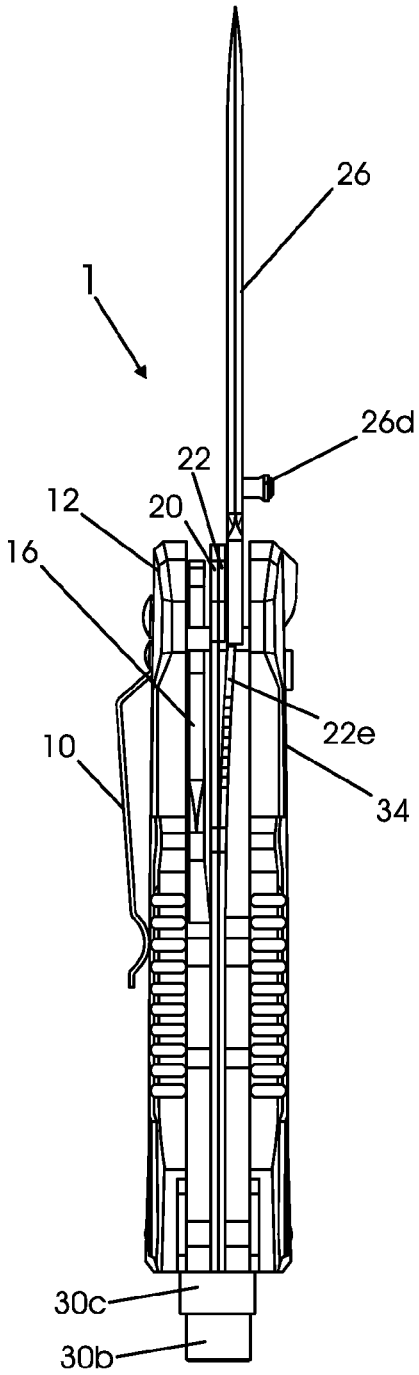
FIG. 9 shows a left side planar orthogonal view of the folding knife of FIG. 1 with the folding knife in the second state of FIG. 2.
Figure 10:
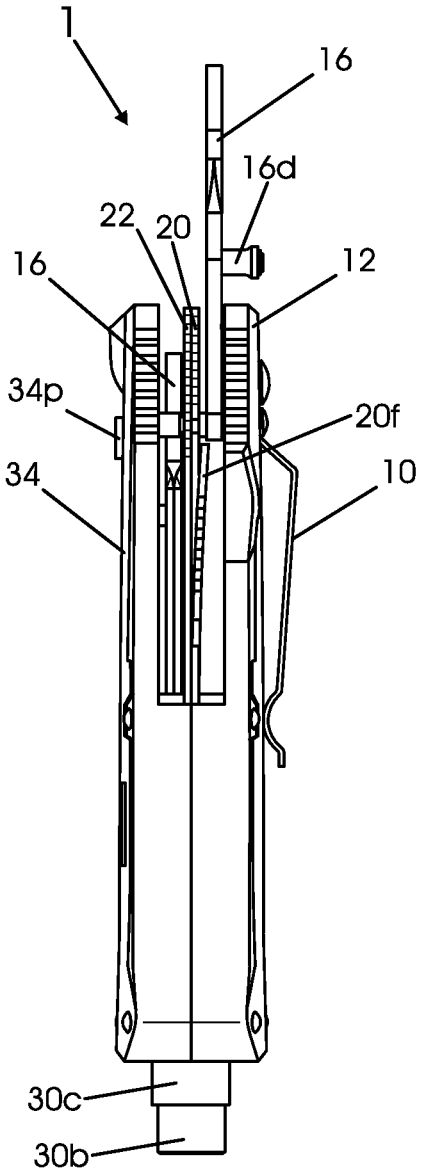
FIG. 10 shows a right side planar orthogonal view of the folding knife of FIG. 1 with the folding knife in the first state of FIG. 1.
Figure 11:
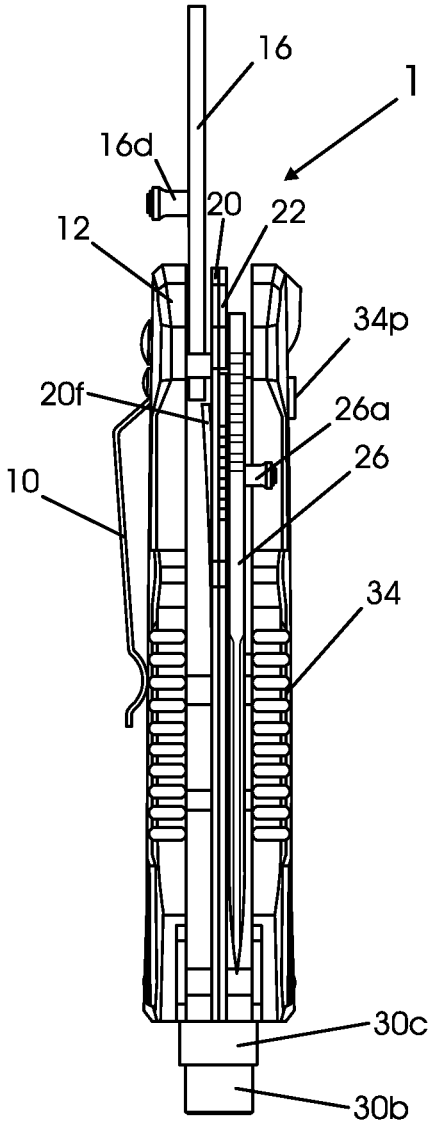
FIG. 11 shows a left side planar orthogonal view of the folding knife of FIG. 1 with the folding knife in the first state of FIG. 1.
Figure 12:
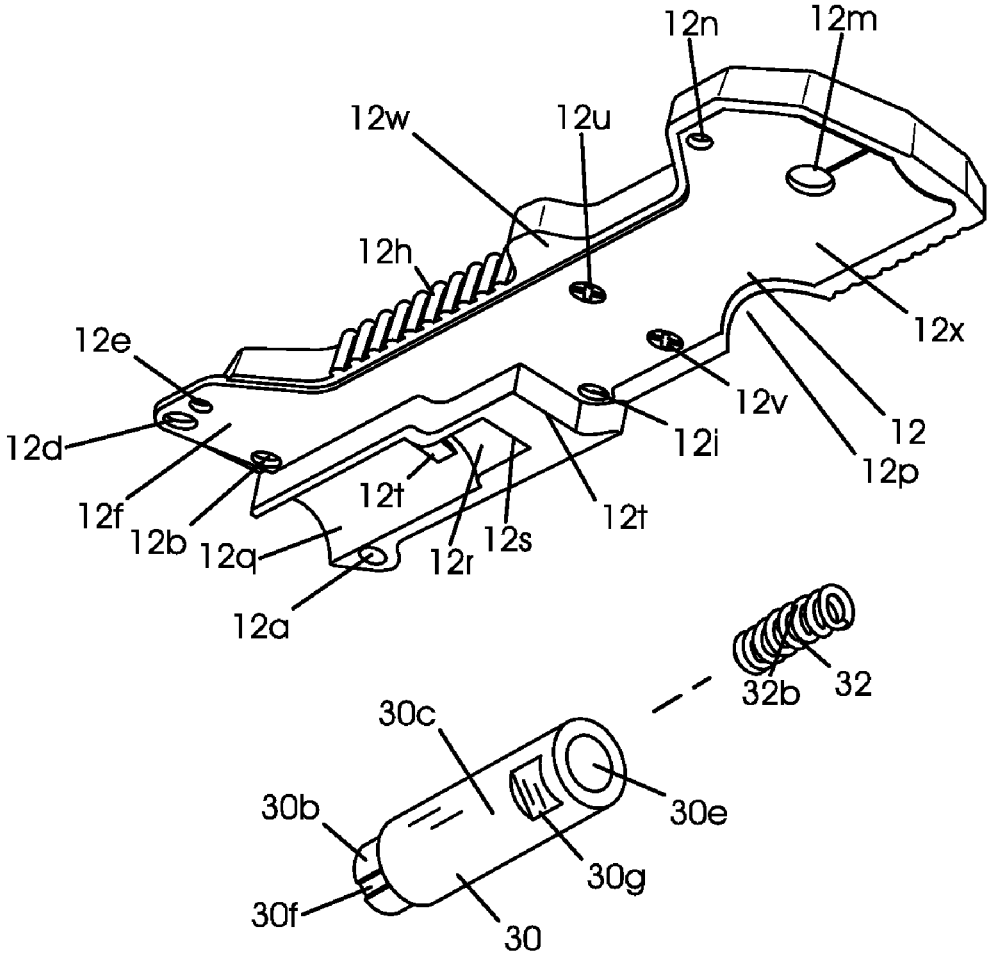
FIG. 12 shows a perspective view of the underside of a top plate or section of the folding knife of FIG. 1 and a perspective view of a cylindrical component and spring of the folding knife of FIG. 1, with the cylindrical component in a non-compressed state.
Figure 13:
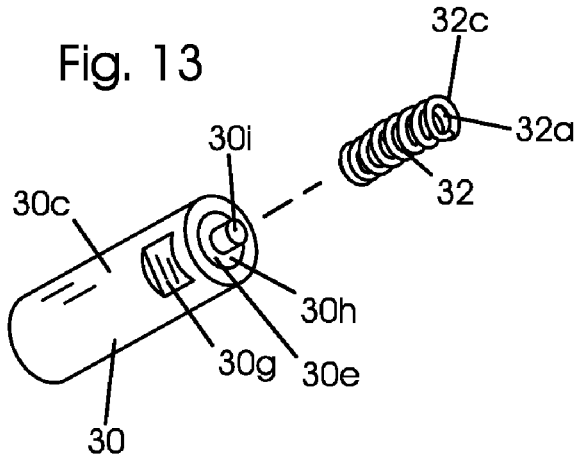
FIG. 13 shows a perspective view of the cylindrical component of FIG. 12, with the cylindrical component in a compressed state.
Figure 14A:
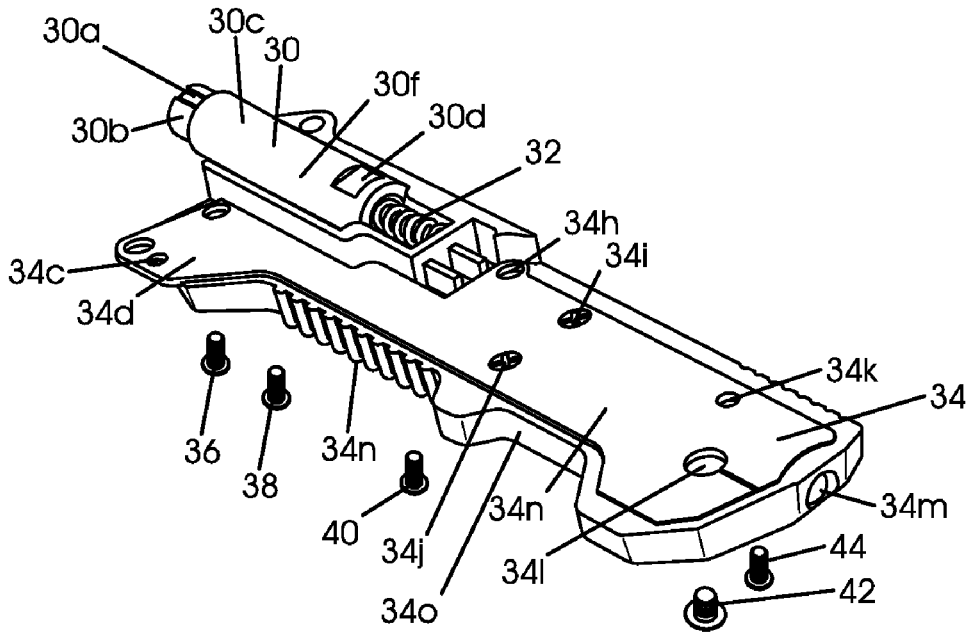
FIG. 14A shows a perspective view of the inside of a bottom plate or section of the folding knife of FIG. 1 with the cylindrical component and the spring of FIG. 12 inserted into the bottom plate or section and with the cylindrical component in a non compressed state.
Figure 14B:
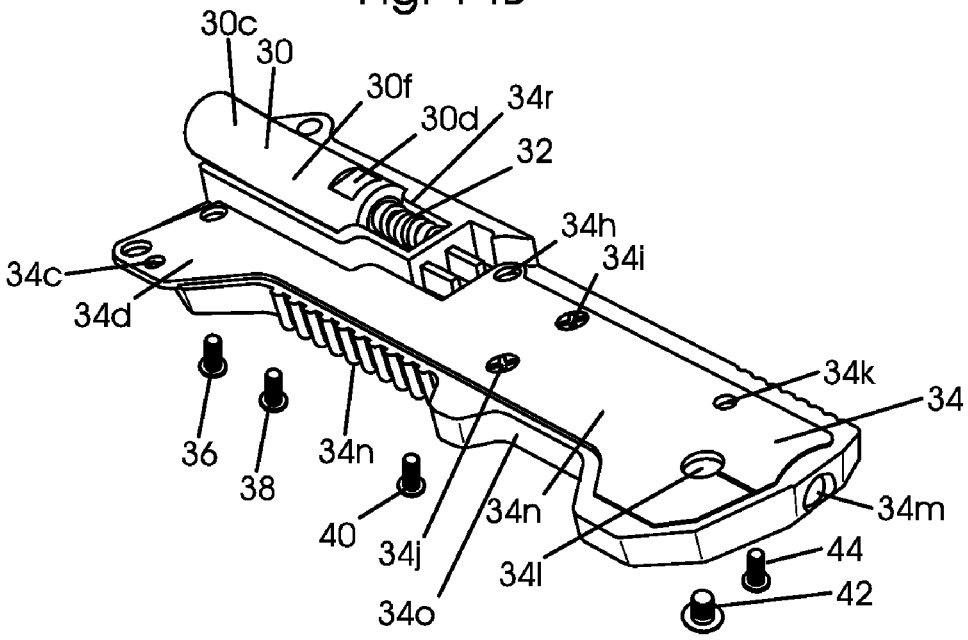
FIG. 14B shows a perspective view of the inside of the bottom plate or section of FIG. 14A with the cylindrical component and the spring of FIG. 12 inserted into the bottom plate or section and with the cylindrical component in a compressed state.
Figure 15:
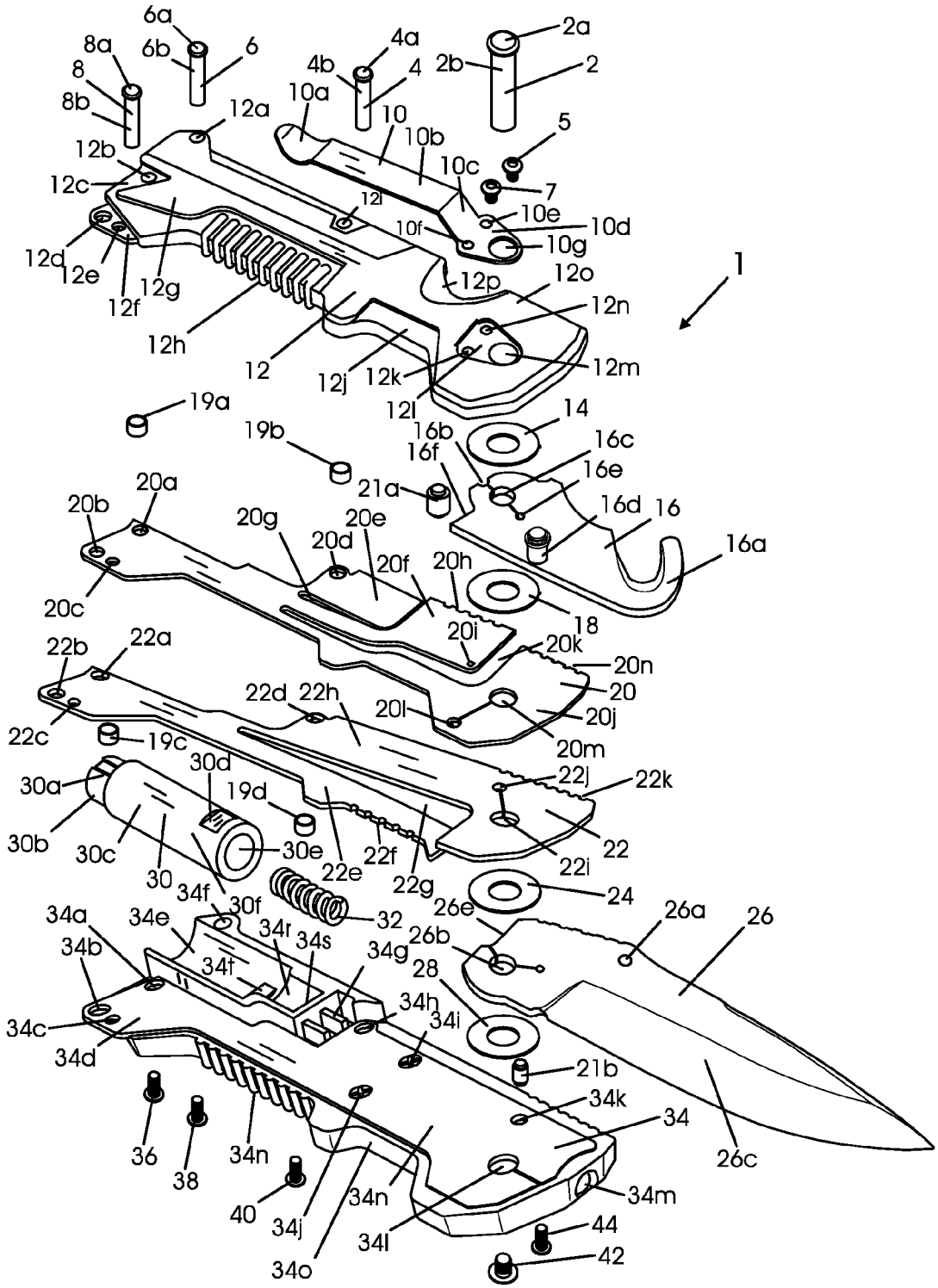
FIG. 15 shows a perspective view of the folding knife with the folding knife taken apart.
Figure 16A:
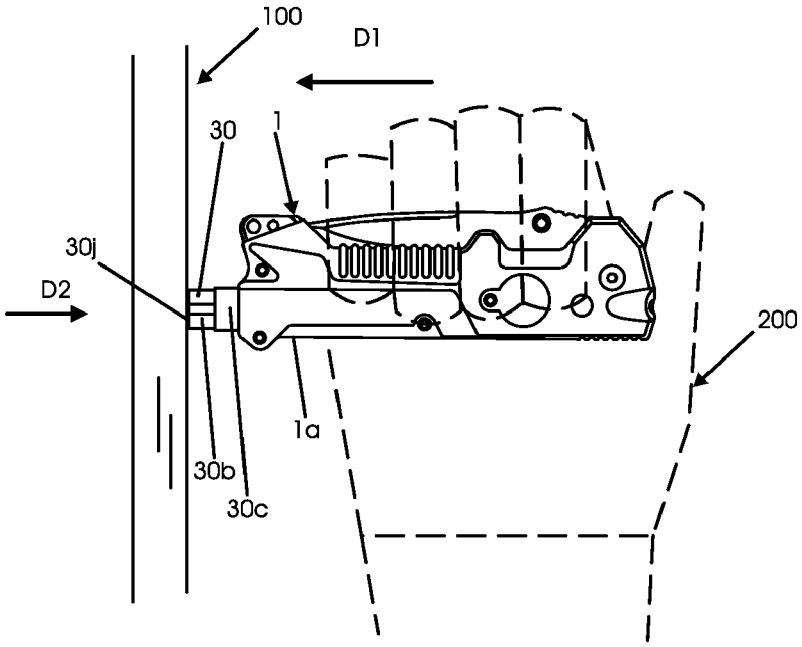
FIG. 16A shows bottom view of the folding knife gripped by a human hand and applied with force to a glass window of a vehicle with the cylindrical component of FIG. 12 shown in a non-compressed state.
Figure 16B:
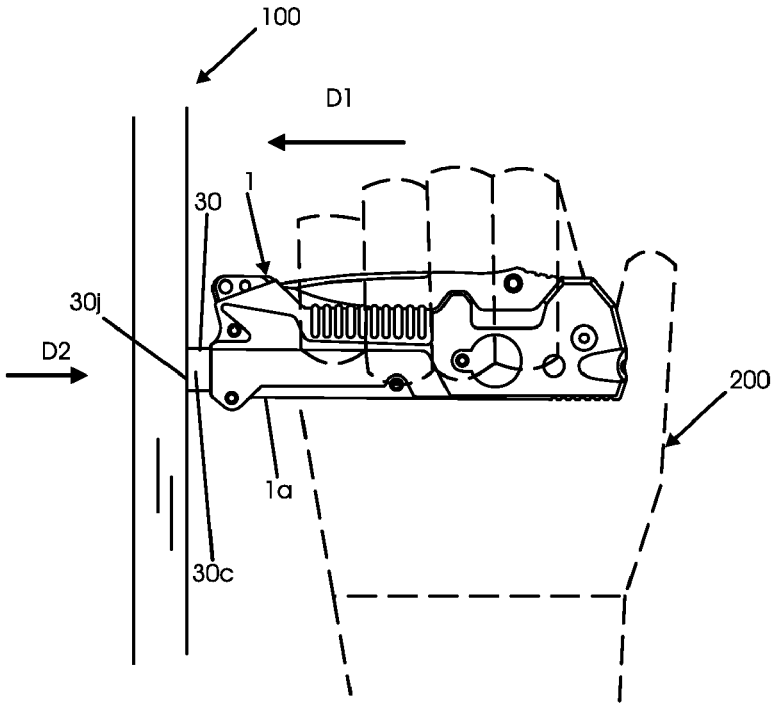
FIG. 16B shows bottom view of the folding knife gripped by a human hand and applied with force to a glass window of a vehicle with the cylindrical component of FIG. 12 shown in a compressed state.

FIG. 5 shows a top planar orthogonal view of the folding knife 1 of FIG. 1 with the folding knife 1 in the first state of FIG. 1, with the device 16 extending from the overall housing 1*a* of the folding knife 1, while the blade 26 is in a closed position;

FIG. 6 shows a front planar orthogonal view of the folding knife 1 of FIG. 1 with the folding knife 1 in the first state of FIG. 1;

FIG. 7 shows a rear planar orthogonal view of the folding knife 1 of FIG. 1 with the folding knife 1 in the first state of FIG. 1;

FIG. 8 shows a right side planar orthogonal view of the folding knife 1 of FIG. 1 with the folding knife 1 in the second state of FIG. 2;

FIG. 9 shows a left side planar orthogonal view of the folding knife 1 of FIG. 1 with the folding knife 1 in the second state of FIG. 2;

FIG. 10 shows a right side planar orthogonal view of the folding knife 1 of FIG. 1 with the folding knife 1 in the first state of FIG. 1;

FIG. 11 shows a left side planar orthogonal view of the folding knife 1 of FIG. 1 with the folding knife 1 in the first state of FIG. 1;

FIG. 12 shows a perspective view of the underside of a top plate or section 12 of the folding knife 1 of FIG. 1 and a perspective view of a cylindrical component 30 and a spring 32 of the folding knife 1 of FIG. 1, with the cylindrical component 30 in a non-compressed state;

FIG. 13 shows a perspective view of the cylindrical component 30 of FIG. 12, with the cylindrical component 30 in a compressed state;

FIG. 14A shows a perspective view of the inside of a bottom plate or section 34 of the folding knife 1 of FIG. 1 with the cylindrical component 30 and the spring 32 of FIG. 12 inserted into the bottom plate or section 34 and with the cylindrical component 30 in a non compressed state;

FIG. 14B shows a perspective view of the inside of the bottom plate or section 34 of FIG. 14A with the cylindrical component 30 and the spring 32 of FIG. 12 inserted into the bottom plate or section 34 and with the cylindrical component 30 in a compressed state;

FIG. 15 shows a perspective view of the folding knife 1 with the folding knife 1 taken apart;

FIG. 16A shows bottom view of the folding knife 1 gripped by a human hand 200 of a human being and applied with force in a direction D1 to a glass window 100, such as a windshield, of a vehicle with the cylindrical component 30 shown in a non-compressed state; and FIG. 16B shows bottom view of the folding knife 1 gripped by the human hand 200 of the human being and applied with force in the direction D1 to the glass window 100 of a vehicle with the cylindrical component 30 in a compressed state.

Referring to FIGS. 1-15 and particularly FIG. 15, the folding knife 1 includes pins 2, 4, 6, and 8, having top cap portions 2*a*, 4*a*, 6*a*, and 8*a*, and cylindrical body portions 2*b*, 4*b*, 6*b*, and 8*b*, respectively. Each of the top cap portions 2*a*, 4*a*, 6*a*, and 8*a* typically has a larger diameter than its corresponding cylindrical body portion of 2*b*, 4*b*, 6*b*, and 8*b*. Each of the pins 2, 4, 6, and 8 can be made of metal, such as steel. Each of the cylindrical body portions 2*b*, 4*b*, 6*b*, and 8*b* is hollow with an opening at an end opposite the respective cap portions 2*a*, 4*a*, 6*a*, and 8*a*, and typically closed at the opposing end of the respective cap portion 2*a*, 4*a*, 6*a*, and 8*a*. The inner walls of the cylindrical body portions 2*b*, 4*b*, 6*b*, and 8*b* have inner threads into which screws or bolts 42, 40, 38, and 36 are adapted to be screwed into, respectively, from the open ends.

The folding knife 1 also includes a clip 10. The clip 10 has a curved end 10*a*, a flat section 10*b*, a ramp or inclined section 10*c*, and a flat tapered section 10*d*. The flat tapered section 10*d*, has openings 10*e* and 10*f* into which screws or bolts 5 and 7, can be inserted, respectively, so that the threaded portions of the screws or bolts 5 and 7 fit through the openings 10*e* and 10*f* respectively, while the head or cap of the screws or bolts 5 and 7 do not fit through the openings 10*e* and 10*f*, respectively. The flat tapered section 10*d* also includes an opening 10*g* into which the cylindrical portion 2*b* of the pin 2 can be inserted. The cap or head portion 2*a* of the pin 2 cannot fit through the opening 10*g*. The clip 10 can be attached by screws 5 and 7 through holes 10*e* and 10*f*, and through threaded openings, bores, or indentations 12*n* and 12*k* of section or plate 12, respectively; and by cylindrical body portion 2*b* of pin 2 through hole 10*g* and hole 12*m* of section or plate 12 to the section or plate 12. The clip can be made of metal, such as stainless steel.

The folding knife 1 also includes the section or plate 12. The section or plate 12 has openings or bores 12*a* and 12*b* into which cylindrical body portions 6*b* and 8*b* can be inserted, but cap portions 6*a* and 8*a* cannot be inserted, respectively. The section or plate 12 also includes openings or bores 12*i* and 12*m* into which cylindrical body portions 4*b* and 2*b* can be inserted, but cap portions 4*a* and 2*a* cannot be inserted, respectively. The section or plate 12 also includes openings, bores or indentations 12*n* and 12*k* which may have inner threads such that threaded sections of screws or bolts 5 and 7 can be inserted into openings, bores or indentations 12*n* and 12*k*, respectively, to attach the clip 10 to the section or plate 12. The section or plate 12 also includes openings 12*d* and 12*e*, which may be for decorative purposes or to help align section or plate 12 with section or plates 20, 22, and 34.

The section or plate 12 also includes a plurality of ribs 12*h* which are useful for gripping the folding knife 1, such as for the purpose to be explained with reference to FIGS. 16A and 16B. The section or plate 12 also includes indented section 12*l* which has substantially the same shape as flat tapered section 10*d* so that flat tapered section 10*d* of the clip 10 can fit snugly into the indented section 12*l* for attaching the clip 10 to the section or plate 12 so that the clip 10 is secure and does not rotate. The section or plate 12 also includes raised section 12*g* indented sections 12*c* and 12*j*. The section may include a curved portion 12*p* which is curved so allow the device 16 to be closed as shown in FIG. 4, so that the post or protrusion 16*d* can fit within the substantially semicircular region defined by curved portion 12*p*.

The underside of section or plate 12 is shown in FIG. 12. As shown in FIG. 12, the section or plate 12 may be comprised of a metal plate 12*x*, which may be a steel metal plate, attached to a hard stiff outer housing, such as a hard plastic outer housing 12*w* by screws 12*u* and 12*v*. The section or plate 12, as shown by FIG. 12 also has indentation, hole or bore 12*n*, into which one end of a stopper or post 21*a* is inserted. The other end of the stopper or post 21*a* is inserted into opening 20*l* in plate or section 20. The stopper or post 21*a* is used to prevent the device 16 from rotating any further clockwise, as viewed in the drawing of FIG. 5, than the position shown in FIG. 5. The underside of section or plate 12 shown in FIG. 12 also shows a substantially half cylindrical cavity 12*q*, a protrusion 12*t*, and a half cylindrical cavity 12*r*. The half cylindrical cavity 12*r* terminates in at solid flat wall 12*s*. A device 30, shown in FIG. 12 is configured to at least partially fit within the half cylindrical cavity 12*q* and a half cylindrical cavity 34*e* of the section or plate 34 as will be explained further later in this application. A spring 32, shown in FIG. 12 is configured to fit partially within a bore or opening 30*e* of the device 30 and simultaneously partially within the half cylindrical cavity 12*r* and within a half cylindrical cavity 34*s* of section or plate 34 shown in FIG. 15. The protrusion 12*t* shown in FIG. 12 and a protrusion 34*t* shown in FIG. 15, fit into indentations 30*d* shown in FIGS. 14A-B and indentation 30*g* shown in FIG. 12, respectively, to hold the device 30 in a fixed position when the folding knife 1 is completely assembled.

The folding knife 1 also includes a washer 14 which may be a flat washer made of nylon or metal, having an opening with a diameter allowing for the insertion of cylindrical body portion 2*b* of the pin 2. The washer 14 is used between the device 16 and the plate or section 12 to allow for smooth rotation of the device 16 from an open position to a closed position and back.

The folding knife 1 may also include the device 16. The device 16 may include a hook 16*a*, a notch 16*b*, an opening 16*c*, a post 16*d*, an opening 16*e*, a flat stopper surface 16*f*, and a slot 16*g*. In the assembled folding knife 1 in the position shown in FIG. 1, the stopper 21*a* contacts or flat stopper surface 16*f* to prevent the device from rotating any further clockwise from the position as viewed in FIG. 5. The slot 16*g* may be about one half inch in length L1 as shown in FIG. 5. A car seat belt, such as seat belt 300 shown by dashed lines in FIG. 5, can be inserted into the slot 16*g*, and the folding knife 1 and device 16 can be used to cut the seat belt 300 to get a driver out of a car after an accident. The device 16 includes a sharp hooked or U-shaped edge for cutting the seat belt 300.

The folding knife 1 may further include a washer 18 similar to the washer 14. The washer 18 has a central opening. The body portion 2*b* of the pin 2 can be inserted through the opening of the washer 18. The washer 18 is used on opposite side of the device 16 (from the side on which washer 14 is used) so that the device 16 can rotate smoothly from an open position to a closed position and back.

The folding knife 1 may further include a section or plate 20 having openings 20*a* and 20*b*. The opening 20*a* is sized so that the cylindrical body portion 8*b* can be inserted into the opening 20*a*. The openings 20*b* and 20*c* may be used for decorative purposes or may be used to align with openings 12*d-e*, 22*b-c*, and 34*b-c*, respectively, to properly align sections 12, 20, 22, and 34 with one another. The section or plate 20 may further include an opening 20*d* which is sized so that the cylindrical body portion 4*b* of the pin 4 can be inserted into the opening 20*d*. The section or plate 20 may further include a leaf portion 20*e* and a leaf portion 20*f* which are separated by a gap or channel 20*g*. The leaf portion 20*f* is separated from a leaf portion 20*j* by a gap 20*k*. The gaps 20*g* and 20*k* allow the leaf portion 20*f* to be flexed with respect to the leaf portions 20*e* and 20*j*. The leaf portion 20*f* includes a portion 20*i* and ridges 20*h*. The leaf portion 20*j* has openings 20*l* and 20*m*. One end of stopper 21*a*, for device 16 is inserted into opening 20*l* as previously mentioned. The cylindrical body portion 2*b* of the main pin 2 is inserted through opening 20*m*. The plate or section 20 also has ridges 20*n* which are used for decorative purposes. The section or plate 20 can be made of metal such as steel.

The portion 20*i* and ridges 20*h* are used as part of a liner lock. The ridges 20*h* add more friction when a user presses down on the leaf portion 20*f* shown in FIG. 11, to close the device 16, which may be called a rescue blade. When leaf 20*f* is raised up as in FIG. 11, the device 16 or rescue blade is in a ready to be used mode. When leaf 20*f* is pressed down, the device 16 or rescue blade can be closed, i.e. placed in the closed position of FIG. 3. Basically the leaf 20*f* is a liner lock used to engage or temporarily lock the device 16 or rescue blade in an opened state or to allow the device 16 to move to a closed state when the leaf 20*f* is pressed down.

In operation, the leaf portion 20*f* flexes outward away from the leaf portions 20*e* and 20*j* in order to keep the device 16 in an open position, i.e. prevent the device 16 from closing, as shown in FIG. 10. The leaf portion 20*f*, in one embodiment, must be pushed in so that it is co planar and aligned with the leaf portions 20*e* and 20*j* in order rotate the device 16 from an open to a closed position. The device 16 in the closed position holds the leaf 20*f* down so that it is substantially co-planar, aligned or most closely aligned with the leaves 20*e* and 20*j* then when the device 16 is in a closed position. The device 16 rotates about the cylindrical portion 2*b* of the pin 2.

The folding knife 1 may include a section or plate 22. The section or plate 22 may have an opening 22*a*, which when the folding knife 1 is completely assembled as in FIG. 1, aligns with the opening 20*a* and the cylindrical body portion 8*b* of the pin 8 can be inserted through the opening 22*a*. The section or plate 22 may also include openings 22*b* and 22*c*, wherein when the folding knife 1 is assembled as in FIG. 1, the openings 22*b* and 22*c* align with the openings 20*b* and 20*c*, but in one embodiment no screws are inserted into openings 22*b-c* and 20*b-c*. The section or plate 22 has an opening 22*d* which aligns with the opening 20*d* when the folding knife 1 is assembled as in FIG. 1. The cylindrical body portion 4*b* of the pin 4 is inserted into the openings 20*d* and 22*d* in order to assemble the folding knife 1 to be in the state of FIG. 1. The section or plate 22 includes leaf 22*h* and leaf 22*e* which are separated by a gap or channel 22*g*, which allows the leaf 22*e* to flex with respect to the leaf 22*h*. The leaf 22*e* has ridges 22*f* which are used to add friction. The leaf 22*h* has openings 22*j* and 22*i*. A stopper 21*b* is used to prevent the blade 26 from rotating further counter clockwise than the position shown in FIG. 4 and is insert at its one end into the opening 22*j* and at its other opposing end into an opening 34*k* of the plate or section 34. The cylindrical body portion 2*b* of the pin 2 is inserted through the opening 22*i* in order to assemble the folding knife 1 into the assembled condition of FIG. 1. The leaf 22*h* has ridges 22*k*. The section or plate 22 may be made of metal such as steel.

In operation, the leaf or leaf portion 22*e* flexes outwards from the leaf portion 22*h* in order to maintain the blade 26 in an open position, as shown in FIG. 9. In order to close the blade 26, in one embodiment, the leaf portion 22*e* must be pushed so that it is typically co-planar and aligned with the leaf portion 22*h*. When the blade 26 is in a closed position, the blade 26 holds the leaf portion 22*e* so that it is co-planar with, aligned with, or more aligned with leaf 22*h*, than the leaf 22*e* is when the blade 26 is in the open position.

The folding knife 1 may also include a washer 24 as shown in FIG. 15. The washer 24 is used between the blade 26 and the section 22 to allow the blade 26 to rotate smoothly from an open position to a closed position and back.

The folding knife 1 may further include the blade 26 having a mark (opposite the pin or post location) 26*a*, a hole 26*b*, a sharp edge 26*c*, and a post or protrusion 26*d* shown in FIGS. 8 and 9. The opening 26*b*, shown in FIG. 15, has a large enough diameter for the insertion of the cylindrical body portion 2*b* of the pin 2. When the folding knife 1 is completely assembled the blade 26 can rotate about the pin 2. The blade 26 also has a flat stopper portion 26*e* which contacts the stopper 21*b* when the blade 26 is in the open position of FIG. 2, and which prevents the blade 26 from rotating any further counter clockwise from the position shown in FIG. 4.

The folding knife 1 may also include a washer 28 as shown in FIG. 15. The washer 28 is used between the blade 26 and the section 34 to allow the blade 26 to rotate smoothly from an open position to a closed position and back.

The folding knife 1 may include the section 30. The section 30 includes substantially cylindrical body portions 30*b* and 30*c*. The substantially cylindrical body portion 30*b* has a slot 30*a* shown in FIG. 15 and an opposite slot 30*f* shown in FIG. 12. The substantially cylindrical body portion 30*c* has an indentation 30*d* shown in FIG. 15 and an opposite indentation 30*g* shown in FIG. 12. The section 30 has a central opening or bore 30*e* at one end of the substantially cylindrical body portion 30*c*. The bore 30*e* has a diameter which is larger than the outer diameter of the spring 32 so that one end 32*b* of the spring 32 can be inserted into the opening or bore 30*e*. The device 30 includes a piston or rod 30*h* having a protrusion or pin 30*i*. The substantially cylindrical portion 30*b* can be pushed into the substantially cylindrical portion 30*c* as shown by FIGS. 12 and 13, until the substantially cylindrical portion 30*b* is completely within a hollow cavity within the substantially cylindrical portion 30*c* and until the protrusion or pin 30*i* protrudes from the bore 30*e* as shown in FIG. 13. The piston or pin 30*i* in inserted at the end 32*b* into the central opening 32*a* of a winding at end 32*b*. Thus when the portion 30*b* is pushed in, the spring 32 is pushed and when inside of the housing 1*a* in the assembled knife 1 is compressed as will be described later.

The spring 32 is inserted so that the circular openings 32*a* of the windings of the spring 32 are penetrated, at least partially by the piston or post 30*i*. The end 32*c* of the spring 32 impacts an inner wall 34*s* when the folding knife 1 is assembled. The section 30 has an inner spring, not shown, inside of substantially cylindrical portion 30*c*. The inner spring biases the section 30 into the state shown in FIG. 12, where the portion 30*b* is extended outside of the portion 30*c*. Force must be applied in the direction D2, shown in FIG. 16A in order to push the portion 30*b* into the portion 30*c* and to put the section 30 into the state shown in FIG. 13. An individual can supply such force by gripping the knife 1 and hitting a glass material 100 of a vehicle, such as windshield with the section 30. When the individual applies the force in the direction D1, upon impact, the glass 100 will apply a force in the opposing direction D2 to force the portion 30*b* back into the portion 30*c*. This force, in the direction D2, causes the inner spring, not shown of device 30 to compress and causes the spring 32 to compress. In this manner the device 30 and the folding knife 1 in general, can be used to break a vehicle material, such as a car windshield glass material. FIG. 16B shows that the portion 30*b* has been pushed into the portion 30*c*.

The folding knife 1 may also include the section or plate 34. The section or plate 34 may have holes or openings 34*a*, 34*b*, and 34*c*. The opening 34*a* aligns with the openings 20*a*, 22*a*, and 12*b* and the cylindrical body portion 8*b* of the pin 8 is inserted simultaneously into the openings 12*b*, 20*a*, 22*a*, and 34 in the assembled form of the folding knife shown in FIG. 1. The section 34 may have hole or opening 34*f* which aligns with hole or opening 12*a* and through which cylindrical body portion 6*b* is inserted in the assembled form of the folding knife 1 shown in FIG. 1. The section or plate 34 also has substantially semi-circular cylindrical cavity 34*e* into which about half of the portion 30*c* of device 30 fits, as shown in FIGS. 14A and 14B. The section or plate 34 also includes ridges 34*n*, which align with ridges 12*h* of section or plate 12 when the folding knife 1 is in the assembled form shown in FIG. 1. The section 30 also has an opening or bore 34*h* which aligns with openings 20*d*, 22*d*, and 12*i* and through which the cylindrical body portion 4*b* of the pin 4 is inserted in the assembled form shown in FIG. 1. The section 34 also includes support ridges or members 34*g* which provide structural support for a force in the direction D2 shown in FIGS. 16A and 16B which cause section 30*b* to be forced back into portion 30*c*. The section 34 includes an opening or indentation 34*l* which aligns with the opening in the washer 28, opening 26*c*, the opening in the washer 24, opening 22*i*, opening 20*m*, the opening in washer 18, opening 16*b*, the opening in washer 14, opening 12*m*, and opening 10*g* and into which the cylindrical body portion 2*b* of the pin 2 is inserted to form the assembled form of the folding knife 1 in FIG. 1. The section 34 may include a top surface plate 34*n* which may be screwed into a bottom surface plate 34*o* by screws or bolts 34*i* and 34*j*. The top surface plate 34*n* may be made of metal such as steel or zinc, and the bottom surface plate 34*o* may be made of a hard stiff material, such as a hard stiff plastic.

The section 34 includes a push button or toggle switch 34*b* shown in FIG. 3. The push button or toggle switch 34*b* when pressed causes an LED light 34*m* to change state. If the LED light 34*m* was in an off state, then pressing the button 34*b* causes the LED light 34*m* to go on. If the LED light 34*m* was in an on state then pushing the push button 34*b* causes the LED light 34*m* to turn off. Circuitry inside of the section 34 may electrically connect the LED light 34*m* with a battery located under portion 34*q* shown in FIG. 3. The portion 34*q* can be taken off by unscrewing a screw or bolt 44 also shown in FIG. 10 to reveal an inner battery for powering the LED light 34*m*

The folding knife 1 includes screw or bolt 38 which is screwed into a hollow inner threaded opening of cylindrical body portion 6*b* to hold sections 12 and 34, and the folding knife 1 in general, together in the assembled form of FIG. 1. In the assembled form of the folding knife 1 of FIG. 1, the cylindrical body portion 6*b* lies inside of openings 12*a* and 34*f*.

The folding knife 1 also includes spacers 19*a*, 19*b*, 19*c*, and 19*d*, each of which may be a metal ring. The spacers 19*a* and 19*b* lie between section 12 and 20, and space sections 12 and 20 apart. Cylindrical body portions 8*b*, and 4*b* of pins 8 and 4 are inserted through the spacers 19*a* and 19*b*, respectively. The spacers 19*c* and 19*d* lie between sections 34 and 22 and space sections 34 and 22 apart. Cylindrical body portions 8*b* and 4*b* of pins 8 and 4, respectively, are inserted through the spacers 19*c* and 19*d*, respectively.

Also provided are screws or bolts 36, 40, and 42 which screw into hollow inner threaded openings of cylindrical body portions 8*b*, 4*b*, and 2*b*, respectively, to hold sections 12 and 34, and the folding knife 1 in general, together. In the assembled form of the folding knife 1 of FIG. 1, the cylindrical body portion 8*b* lies inside of openings 12*b*, 20*a*, 22*a*, and 34*a* (which are aligned with each other) to connect the sections 12, 20, 22, and 34 together. In the assembled form of the folding knife 1 of FIG. 1, the cylindrical body portion 4*b* lies inside of openings 12*i*, 20*d*, 22*d*, and 34*h* (which are aligned with each other) to connect the sections 12, 20, 22, and 34 together. In the assembled form of the folding knife 1 of FIG. 1, the cylindrical body portion 2*b* lies inside of openings 10*g*, 12*m*, the opening of washer 14, 16*c*, the opening of washer 18, 20*m*, 22*i*, the opening of washer 24, 26*c*, the opening of washer 28, and 34*l* (which are aligned with each other) to connect the components 10, 12, 14, 16, 18, 20, 22, 24, 26, 28, and 34 together, in a manner which allows the device 16 and the blade 26 to pivot about cylindrical body portion 2*b*.

FIGS. 16A-B show a hand 200 of a person gripping the folding knife 1, while the folding knife 1 is in a closed state, and with the hand 200 applying a force in the direction D1 at a car windshield 100 to break the windshield. Force is applied in the direction D1 in FIG. 16A, so that the front surface 30*j* of the portion 30*b* of the section 30 impacts with the windshield 100 with sufficient force to break the windshield 100. The collision of the windshield 100 with the section 30 shown in FIGS. 16A-B, causes the portion 30*b* to go into the portion 30*c* in the direction D2 and to compress the spring 32 as shown by FIG. 16B in conjunction with FIG. 14B. FIG. 14B shows the spring 32 compressed into the substantially semi-circular cylindrical cavity 34*r*. The spring 32 is a high compression spring. Portions 30*b* and 30*c* of section 30 may be made of a hard plastic material. When the portion 30*b* is pushed in the direction D2, the portion 30*b* is pushed into the portion 30*c*, and the portion 30*b* pushes the piston or rod 34*h* into the spring 32 causes the spring 32 to push against the wall 34*s*, which causes compression of the spring 32 shown by the combination of FIGS. 14A-B, FIG. 15, and FIGS. 16A-B. The wall or inner surface 34*s* is made of a hard material such as a hard plastic and is reinforced by members or rails 34*g*.

When the knife 1 is assembled, the portion 30*c* sits in a substantially cylindrical cavity or compartment comprised of substantially semi-circular cavity 34*e* of member 34, on the bottom, shown in FIG. 15, and substantially semi-circular cavity 12*q* of member 12 shown in FIG. 12, on the top. The portion 30*c* is held in the cavity comprised of 34*e* and 12*q* by protrusions 12*t* and 34*t* which are inserted in indentations 30*g* and 30*d*, respectively.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a housing which includes a first member, wherein the housing has a length;

a knife connected to the housing, wherein the knife at least partially folds into the housing; and a first device for cracking a vehicle windshield, wherein the first device is connected to the housing; and wherein the first device includes a first spring and a second member;

wherein the first device is configured with respect to the housing so that the second member of the first device can be compressed into the first member of the housing, to cause the first spring to compress, or the second member of the first device can be expanded away from the first member of the housing, to cause the first spring to expand;

wherein the first device is configured with respect to the housing so that the second member of the first device, in a rest state, can only protrude out from the first member of the housing a first distance parallel to the length of the housing;

wherein the first device is configured with respect to the housing so that the second member of the first device has a width which is perpendicular to the length of the housing and which is greater than or equal to the first distance;

and wherein the first device is configured with respect to the housing so that a force can be applied to the second member which pushes the second member at least partially into the first member of the housing and which causes the first spring to compress.

2. The apparatus of claim 1 further comprising a second device for cutting a vehicle seat belt, wherein the second device is connected to the housing and at least partially folds into the housing.

3. The apparatus of claim 1 wherein the knife is connected to the housing so that the knife rotates in order to at least partially fold into the housing.

4. The apparatus of claim 1 wherein the second member of the first device, in the rest state, protrudes out from a front end of the housing;

and further comprising a light source fixed to the housing at a back end of the housing which is opposite the front end of the housing.

5. The apparatus of claim 2 wherein the second device is connected to the housing so that the second device rotates in order to at least partially fold into the housing.

6. The apparatus of claim 4 further comprising a second device for cutting a vehicle seat belt, wherein the second device is connected to the housing and at least partially folds into the housing.

7. The apparatus of claim 1 wherein the second member of the first device is configured to slide into the first member of the housing when the force is applied to the second member which pushes the second member at least partially into the first member of the housing.

8. The apparatus of claim 1 wherein the first member of the housing is substantially cylindrical and the second member of the first device is substantially cylindrical.

9. An apparatus comprising:

a housing;

a knife connected to the housing, wherein the knife at least partially folds into the housing; and a first device for cutting a vehicle seat belt, wherein the first device is connected to the housing and at least partially folds into the housing;

a second device for cracking a vehicle windshield, wherein the second device is connected to the housing;

wherein the knife, the first device for cutting a vehicle seat belt, and the second device for cracking a vehicle windshield are separate from each other, so that each can be moved without moving any of the other of the knife, the first device for cutting a vehicle seat belt, and the second device for cracking a vehicle windshield;

wherein the second device for cracking a windshield includes a first spring and a first member; and wherein the second device for cracking a windshield is configured with respect to the housing so that the first member of the second device can be compressed into the housing by compressing the first spring or the first member of the second device can be expanded away from the housing by expanding the first spring.

10. The apparatus of claim 9 wherein the first device is connected to the housing so that the first device rotates in order to at least partially fold into the housing.

11. The apparatus of claim 10 wherein the first device includes a U-shaped cutting edge located within an interior of a hook.

12. A method comprising gripping an apparatus using a person's hand; and hitting a vehicle windshield with the apparatus while gripping the apparatus using the person's hand;

wherein the apparatus includes:

a housing which includes a first member, wherein the housing has a length;

a knife connected to the housing, wherein the knife at least partially folds into the housing; and a first device for cracking a vehicle windshield, wherein the first device is connected to the housing;

wherein the first device includes a first spring and a second member;

wherein the first device is configured with respect to the housing so that the second member of the first device can be compressed into the first member of the housing, to cause compression of the first spring, or the second member of the first device can be expanded away from the first member of the housing, to cause expansion of the first spring;

wherein the first device is configured with respect to the housing so that the second member of the first device, in a rest state, can only protrude out from the first member of the housing a first distance parallel to the length of the housing;

wherein the first device is configured with respect to the housing so that the second member of the first device has a width which is perpendicular to the length of the housing and which is greater than or equal to the first distance;

and wherein the first device is configured with respect to the housing so that a force can be applied to the second member which pushes the second member at least partially into the first member of the housing and which causes the first spring to compress.

13. The method of claim 12 further comprising cutting a vehicle seat belt using a second device of the apparatus;

wherein the second device is connected to the housing and at least partially folds into the housing.

14. The method of claim 12 wherein the knife is connected to the housing so that the knife rotates in order to at least partially fold into the housing.

15. The method of claim 12 wherein the second member of the first device, in the rest state, protrudes out from a front end of the housing;

and wherein the apparatus includes a light source fixed to the housing at a back end of the housing which is opposite the front end of the housing;

and wherein the method further includes activating the light source so that it emits light out from the back end of the housing.

16. The method of claim 13 wherein the second device is connected to the housing so that the second device rotates in order to at least partially fold into the housing.

17. The method of claim 13 wherein the second member of the first device, in the rest state, protrudes out from a front end of the housing;

and wherein the apparatus includes a light source fixed to the housing at a back end of the housing which is opposite the front end of the housing;

and wherein the method further includes activating the light source so that it emits light out from the back end of the housing.

18. The method of claim 12 wherein the second member is configured to slide into the first member when the force is applied to the second member which pushes the second member at least partially into the first member of the housing.

19. The method of claim 18 wherein the first member is substantially cylindrical and the second member is substantially cylindrical.

20. A method comprising gripping an apparatus using a person's hand;

cutting a vehicle seat belt using a first device of the apparatus; and cracking a vehicle windshield using a second device of the apparatus;

wherein the apparatus includes:

a housing;

a knife connected to the housing, wherein the knife at least partially folds into the housing;

the first device, wherein the first device is connected to the housing, and at least partially folds into the housing; and a second device for cracking a vehicle windshield, wherein the second device is connected to the housing;

wherein the knife, the first device for cutting a vehicle seat belt, and the second device for cracking a vehicle windshield are separate from each other, so that each can be moved without moving any of the other of the knife, the first device for cutting a vehicle seat belt, and the second device for cracking a vehicle windshield;

wherein the second device for cracking a vehicle windshield includes a first spring and a first member; and wherein the second device for cracking a vehicle windshield is configured with respect to the housing so that the first member of the second device can be compressed into the housing by compressing the first spring or expanded away from the housing by expanding the first spring.

* * * * *